United States Patent [19]

Shinichiro

[11] 4,079,732

[45] Mar. 21, 1978

[54] ELECTROMOTIVE MASSAGE APPARATUS FOR BEATING AND KNEADING BODY

[76] Inventor: Shinichiro Fujimoto, 6-8 Hannanchounaka, Abeno, Osaka, Japan

[21] Appl. No.: 703,437

[22] Filed: Jul. 8, 1976

[51] Int. Cl.[2] ..... A61H 23/00

[52] U.S. Cl. ..... 128/55; 128/57

[58] Field of Search ..... 128/44, 55, 24.2, 49, 128/57, 58, 54

[56] References Cited

U.S. PATENT DOCUMENTS

| | | | |
|---|---|---|---|
| 3,424,149 | 1/1969 | Fujimoto | 128/55 |
| 3,800,785 | 4/1974 | Inada | 128/55 |
| 3,939,826 | 2/1976 | Fujimoto | 128/55 |
| 4,009,710 | 3/1977 | Inada | 128/44 |

*Primary Examiner*—Lawrence W. Trapp

*Attorney, Agent, or Firm*—Holman & Stern

[57] ABSTRACT

An electromotive massage apparatus for beating and kneading body comprises joint means interconnected loosely and pivotably elevating means and supporting means having vibrator means in association with electrically driven power means. Revolution of a first transmission shaft from a motor is diminished and transmitted to a second transmission shaft through gear means. Said supporting means which engaged with eccentric axes means at both ends of the second transmission shaft change the eccentric revolution to reciprocal movement which is transmitted to vibrators as complex oscillating movement through joint means and arm spindles.

3 Claims, 6 Drawing Figures

(A)

(B)

ELECTROMOTIVE MASSAGE APPARATUS FOR BEATING AND KNEADING BODY

BACKGROUND OF THE INVENTION

This invention relates to an electromotive massage apparatus and more particularly to vibrators operating means of the massage apparatus to beat and knead body with a single unit as the motor rotates clockwise or counteclockwise.

Massage is used primarily to aid circulation of blood and relieve local pain or muscle spasm. It is usually applied by the hands, although swirling water or mechanical devices may be employed. With tendency of increased rationality and speed with which massage is being used, various types of mechanical devices have been utilized in order to massage efficiently. Generally, the most common strokes on the electromotive massage apparatus are alternatively either of beating or kneading body and therefore it has been impossible to beat and knead body with a single unit. Thus it is always necessary to have an electromotive massage apparatus for beating as well as kneading body in order to increase therapeutic effect and desirable ecconomic advantages.

SUMMARY OF THE INVENTION

An electromotive massage apparatus for beating and kneading body comprises joint means interconnected loosely and pivotably on elevating means and supporting means having vibrator means in association with a motor. Said supporting means which are engaged with eccentric axes means formed at both ends of a second transmission shaft which transmits rotary motion diminished by gear means from a first transmission shaft and the motor, horizontally and vertically with respect to the axes oscillate vibrator means.

Revolution of the motor is transmitted to the first transmission shaft through a pulley and a belt and the transmitted revolution is diminished by the gear means and then is transmitted to the second transmission shaft. The revolution is changed into reciprocating horizontal and vertical movement on the supporting means by means of eccentric means and joint means which are mounted with said supporting means and further this reciprocating movement is transmitted to a pair of arm spindles on which vibrator balls are respectively fixed at top portion.

Accordingly, an object of the present invention is to overcome the aforementioned disadvantages of prior arts and provide and improvement which resides in the novel parts and combination of parts.

Another object of the present invention is to effect a secure and speedy change of the vibrators movements by the joint means and eccentric axes means.

A further object of the present invention is to provide the device of the aforesaid type which is constructed and is inexpensive to manufacture.

Other object and many of the attendent advantages of this invention will be readilly appreciated as the same becomes better understood by reference to the following description.

BRIEF DESCRIPTION OF THE DRAWINGS

The accompanying drawings illustrate the preferred embodiment of the present invention. In the drawings, the same reference numerals illustrate the same parts of the invention in which.

THE DETAILED DESCRIPTION OF THE INVENTION

Figure 1:
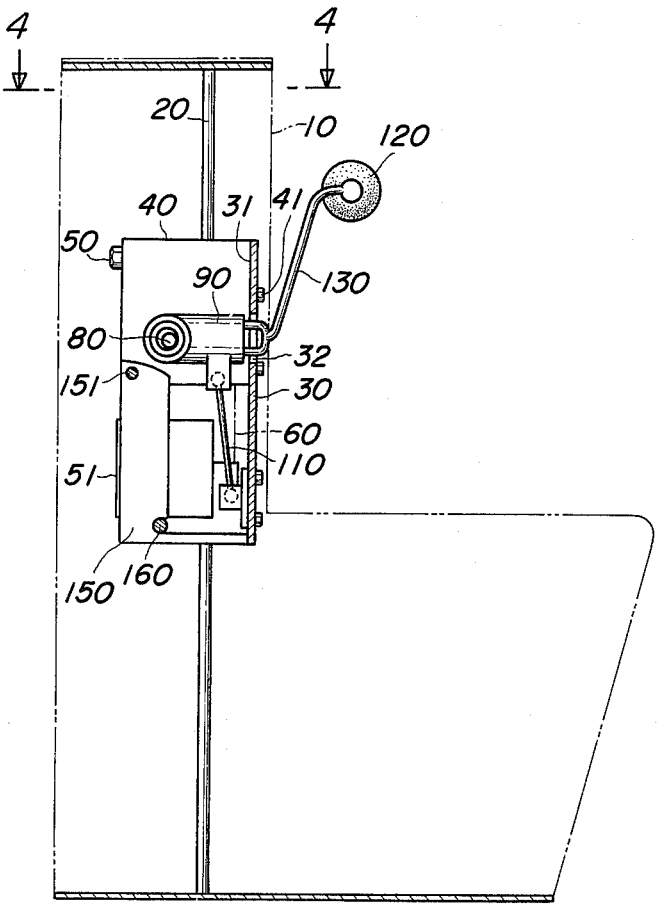
FIG. 1 is a diagrammatic side elevation of the preferred embodiment of the present invention.
Figure 2:
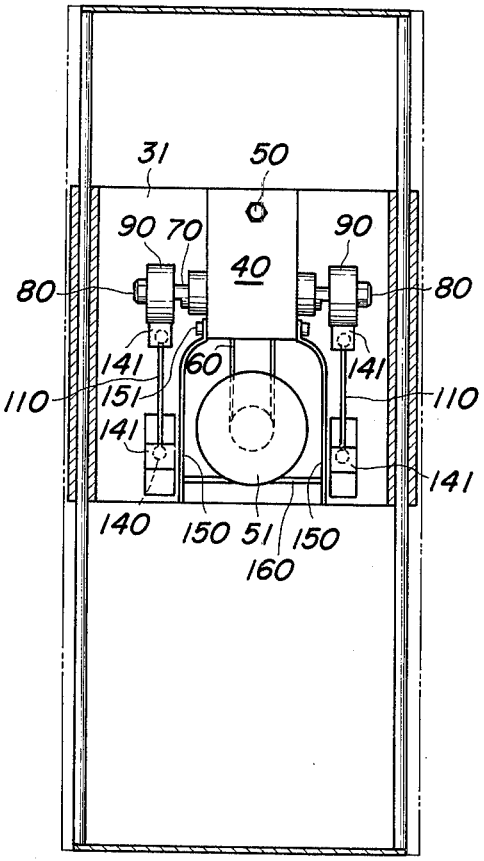
FIG. 2 is a rear elevation and partial cutaway view.
Figure 3:
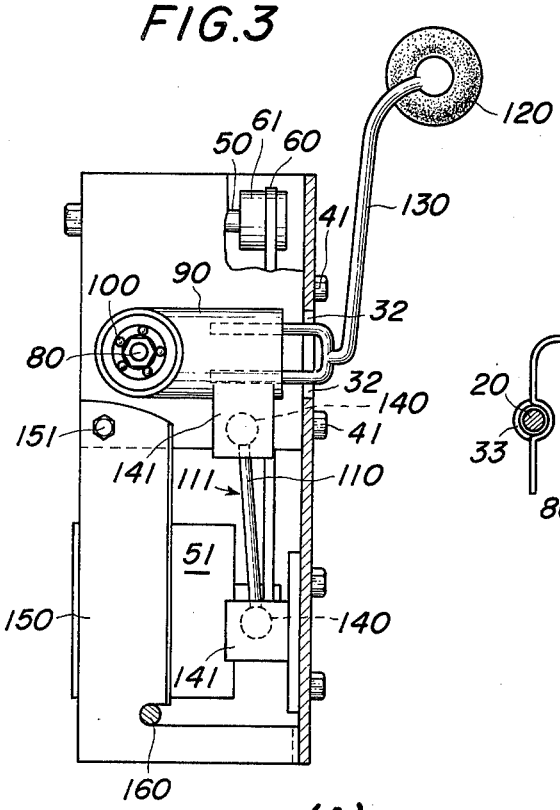
FIG. 3 is a greatly enlarged detailed view of a vibrator operating main means.
Figure 4:
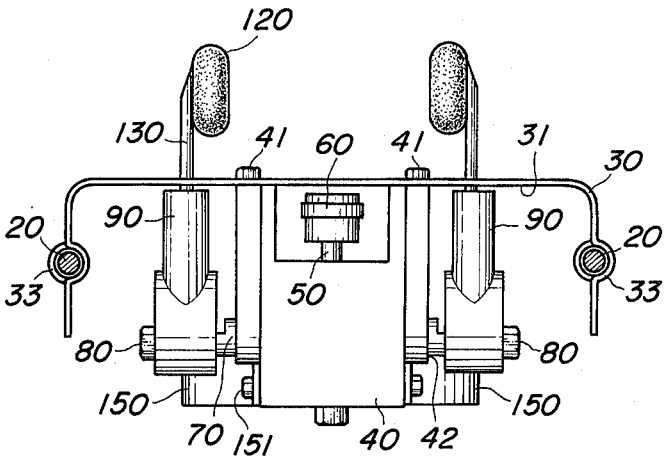
FIG. 4 is a top plane view of the line 4—4 in FIG. 1, FIG. 5 (A) is a diagrammatic illustration of vibrators vertically movement by the joint means, supporting means and eccentric axes means, FIG. 5 (B) is a diagrammatic illustration of vibrators horizontally movement by the joit means, supporting means.

Referring to the drawings there is shown according to a preferred embodiment of the invention, an electromotive massage apparatus 10 has a pair of guide columns 20 which are secured vertically and symmetically on right and left sides. An elevating means consists of an elevating plate 30 which is formed in an U-shape and has a pair of slits 32 through the front part and a pair of cylindrical parts 33 at the sides thereof. The elevating plate 30 is connected drivably and slidably to the guide columns 20 which are inserted into the cylindrical part 33. A conventional elevating apparatus and switch means are not shown in the drawings.

A gear box 40 is fixed at the rear surface of the elevating plate 30 by the bolt means 41 and is equipped with gear devices therein. Holes 42 are made in both side plates of the gear box 40.

A first transmission shaft 50 is rotatably and drivably supported in direction before and behind within upper portion of the gear box 40, and has a pulley 61 at the frontal end portion, which the first transmission shaft 50 is driven by a motor 51 through a belt 60 engaged on the motore 51 and the pulley 61.

A second transmission shaft 70 is rotatably and drivably supported in direction of right and left within lower portion of the gear box 40, and is formed a pair of eccentric axes 80 at both ends which are projected outwardly through the hole 42 of the both side plates of the gear box 40.

The both transmission shaft 50 and 70 have gear devices at the portion being in the gear box 40. Said gear devices for diminution of rotating speed in the gear box 40 are engaged on the both gear devices of the both transmission shaft 50 and 70. The rotating power of the motor 51 is transmitted to the first transmission shaft 50, and such rotating power is also transmitted to the second transmission shaft 70 from the first transmission shaft 50 through said gear devices in the gear box 40, and rotating speed of the first transmission shaft 50 is diminished and transmitted to the second transmission shaft 70 by said gear devices.

A pair of supporting devices 90 are set on said both eccentric axes 80 of the second transmission shaft 70 through bearings 100 at rear part, and are fixed the each lower end of a pair of arm spindles 130 at fore part. The arm spindles 130 have respectively an each of vibrators 120 at the top portion, and the arm spindles are upwardly projected from the elevating plate 30 through the both slits 32.

A pair of joints 111 are provided and are composed of a pair of rods 110 fixed respectively an each of small balls 140 at their both ends, and two pairs of housings 141 which are loosely accomodated for the balls. One pair of housings which loosely accomodate in a universal fashion the balls, are adapted to the supporting devices 90 at the bottom portion, and another pair of housings which loosely accomodate in a universal fashion another pair of balls, are adapted to the elevating plate 30 respectively. The supporting devices 90 are universally linked with respectively the elevating plate 30 through the joint means 111. The elevating plate 30 has a pair of side plates 150 connected behind the rear surface of it, and the top portion of the side plates 150 are fixed under the gear box 40 by the bolt means 151. A yoke 160 is settled through the lower portion of the both side plates 150, and the motor 51 is placed on the yoke means 160.

Figure 5:
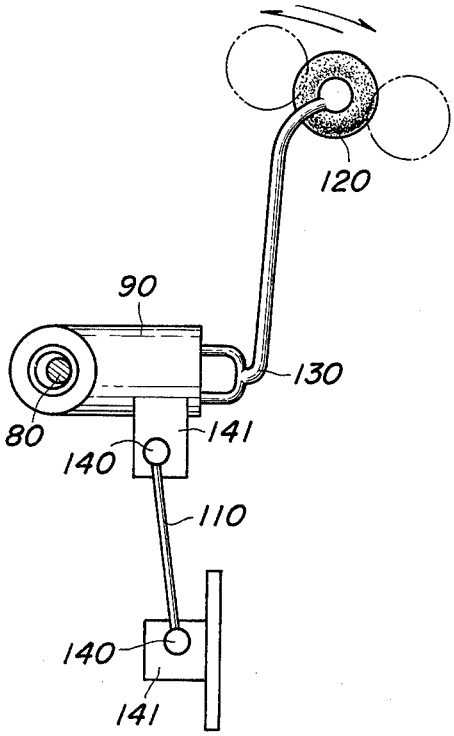
Figure 5:
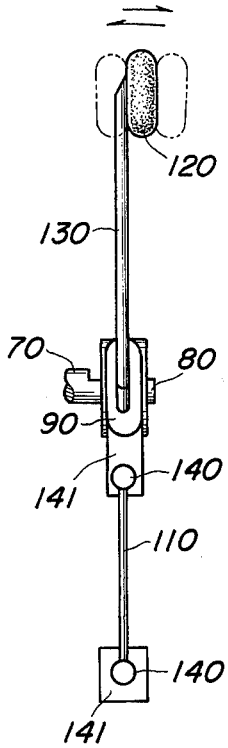

The eccentrically rotating movement of the eccentric axes 80 of the second transmission shaft 70 is changed to reciprocating movement of the supporting devices 90 by the joint means 111, and then the arm spindles 130 are enlargedly oscillated in accordance with the reciprocating movement of the supporting devices 90. The vibrators 120 are vibrated vertically in accordance with oscillation of the arm spindles 130 as shown in FIG. 5 (A). The rods 110 of the joint means are reciprocally oscillated within the bounds of action radius along the reciprocating movement of the supporting devices 90.

The small balls 140 fixed on each end of the rods 90 are loosely held in the housings, and particularly are accomodated loosely in the housing fixed under the supporting devices 90. Consequently, when the supporting devices 90 are driven reciprocatively, the rods 110 are also reciprocatively oscillated in direction of before and behind, and moreover are oscillated in direction of right and left by slidingly movement of the ball 140 along the inner surface of the housings within the space thereof.

In operation, after setting the elevating plate 30 to the desired height portion of the guide columns within the massage apparatus 10, when the first transmission shaft 50 rotates clockwise according to clockwise revolution of the motor 51 by switch operation, the second transmission shaft 70 rotates and the rotating speed is diminished by the gear means in the gear box 40, and then the eccentric axes 80 of the second transmission shaft 90 rotates eccentrically. The eccentric revolution of the eccentric axes 80 is changed to reciprocal movement of the supporting devices 90 in association with the rods 110, and then the reciprocal movement is transmitted to the vibrators 120 through the arm spindles 130. As described above, the vibrators 120 are oscillated vertically as shown in FIG. 5 (A) and furthermore are oscillated horizontally as shown in FIG. 5 (B) by the reciprocal movement in direction to right and left of the rods 110 which are loosely accomodated and universally jointed to the supporting devices 90.

Consequently complex movements occur on the supporting devices 90 and are transmitted enlargedly to the vibrators 120 through the arm spindles 130. The vibrators 120 operate for beating and kneading and vibrating body as complex massage. And so, the present invention is to provide the device of this type which is simple in construction and inexpensive to manufacture.

The invention may be embodied in other specific forms without departing from its spirit or essential characteristics. The descibed embodiment is to be considered in all respects only as illustrative and not respective and the scope of the invention is, therefore, indicated by the appendant claims rather than by the foregoing description. All changes which come within the meaning and range of equivalency of the claims are to be amended within their scope.

What is claimed is:

1. An electromotive massage apparatus for use to beating and kneading body comprising:

guide columns, an electrically-driven power means for driving a shaft rotatably, an elevating means having an elevating plate drivably connected to said guide columns and including a pair of side plates and a yoke on which the electrically-driven power means is carried, power transmission means including first and second transmission shafts, a pulley adapted to be driven through a belt engaged with said shaft on the electrically-driven power means, and gear means engaging said first transmission shaft and said second transmission shaft, said second transmission shaft including a pair of eccentric axes means formed at both ends, a pair of arm spindles, each having a top portion and a lower end, a pair of vibrators connected on the top portions of said pair of arm spindles which project through the elevating plate, a pair of supporting means, each having a fore part and a rear part, connecting each lower end of said arm spindles at said fore part and each operatively associated with one of said eccentric axis of said second transmission shaft at its rear part, and a pair of joint means including a pair of rods and two pairs of balls respectively connected to each end of said rods and two pairs of small housings for accomodation of said balls for linking the supporting means with the elevating plate.

2. An electromotive massage apparatus for use to beating and kneading body as in claim 1 wherein said eccentric axes means include bearings around said each axis.

3. An electromotive massage apparatus for use to beating and kneading body as in claim 1 wherein one of each pair of said housings are secured to the bottom of the supporting means, the upper balls of the joint means being therein disposed loosely and universally, and the other of each pair of said housings being fixed behind the elevating plate, the lower balls of the joint means being therein disposed loosely and universally.

* * * * *